US006368005B1

(12) United States Patent
Streff et al.

(10) Patent No.: US 6,368,005 B1
(45) Date of Patent: Apr. 9, 2002

(54) LOOSE LEAF BINDER INCLUDING AN EXTERIOR PICTURE FRAME

(75) Inventors: William J. Streff, Menomonee Falls; Kenneth R. Green, Germantown, both of WI (US)

(73) Assignee: H.C. Miller Company, Milwaukee, WI (US)

( * ) Notice: Subject to any disclaimer, the term of this patent is extended or adjusted under 35 U.S.C. 154(b) by 0 days.

(21) Appl. No.: 08/978,553

(22) Filed: Nov. 26, 1997

Related U.S. Application Data

(63) Continuation-in-part of application No. 08/767,940, filed on Dec. 17, 1996, now Pat. No. 5,857,797.

(51) Int. Cl.[7] ..... B42D 3/00; B42D 3/12; B42D 3/18; B42F 13/00

(52) U.S. Cl. ..... 402/3; 281/29; 281/31; 281/37; 402/4; 402/73; 402/80 R

(58) Field of Search ..... 40/359; 281/15.1, 281/21.1, 29, 30, 31, 37, 48; 402/3, 4, 70, 73, 74, 75, 80 R, 502; 412/3, 17

(56) References Cited

U.S. PATENT DOCUMENTS

| | | | | | |
|---|---|---|---|---|---|
| 2,568,178 | A | * | 9/1951 | Widder | 40/158 |
| 2,639,254 | A | * | 5/1953 | Smith | 154/116 |
| 2,704,546 | A | * | 3/1955 | Slonneger | 281/31 |
| 3,810,324 | A | * | 5/1974 | Hart | 40/158 |
| 3,814,527 | A | * | 6/1974 | Lawes | 402/3 |
| 4,172,332 | A | | 10/1979 | Holes et al. | |
| 4,275,517 | A | * | 6/1981 | Blanchard | 40/159 |
| 4,629,349 | A | * | 12/1986 | Pitts | 402/74 |
| 4,640,413 | A | | 2/1987 | Kaplan et al. | |
| 4,795,194 | A | | 1/1989 | Etheredge | |
| 4,828,421 | A | | 5/1989 | Arakaki | |
| 4,831,756 | A | | 5/1989 | Huang et al. | |
| 5,030,027 | A | | 7/1991 | Bachrach et al. | |
| 5,114,009 | A | | 5/1992 | Johnston | |
| 5,240,340 | A | | 8/1993 | Lynch et al. | |
| 5,330,279 | A | | 7/1994 | Ruble | |
| 5,368,333 | A | | 11/1994 | Arroyo | |
| 5,411,293 | A | * | 5/1995 | Monzyk | 281/31 |
| 5,445,417 | A | * | 8/1995 | Bromer et al. | 281/46 |
| 5,509,746 | A | | 4/1996 | Ho | |
| 5,562,309 | A | * | 10/1996 | Brink et al. | 281/15.1 |
| 5,671,950 | A | * | 9/1997 | Hanson | 281/29 |
| 5,711,627 | A | * | 1/1998 | Chapman | 402/3 |
| 5,720,564 | A | * | 2/1998 | Winzen | 402/73 |

FOREIGN PATENT DOCUMENTS

| | | | | |
|---|---|---|---|---|
| GB | 363876 | * | 12/1931 | 281/31 |

* cited by examiner

*Primary Examiner*—Andrea L. Pitts
(74) *Attorney, Agent, or Firm*—Oppenheimer Wolff & Donnelly, LLP

(57) ABSTRACT

A three ring binder includes a spine, front cover and back cover, each of which includes a substantially solid base plate and an outer plastic shell. The spine and front cover each includes a rectangular picture frame, the outer edges of which are aligned with and welded to the bottom and side edges of the spine and cover. A clear plastic membrane is secured to the frame's interior covering the opening in the picture frame. The frame top edges are spaced inwardly and free of the shell to form insert pockets. Display inserts are slidably mounted within the insert pockets defined by the frames. The spine insert includes an upper folded edge, and includes an outer pin head. Pulling upwardly on the pin head withdraws the insert. Mount-mats of a semi-solid paper are provided in the pockets to receive thin, flexible paper for insertion into the frame pockets. The inserted mat holds the display material with the insert pocket. The frame may be of thin flexible opaque plastic sheet material less than 0.020 inch thick.

22 Claims, 5 Drawing Sheets

FIG. 1
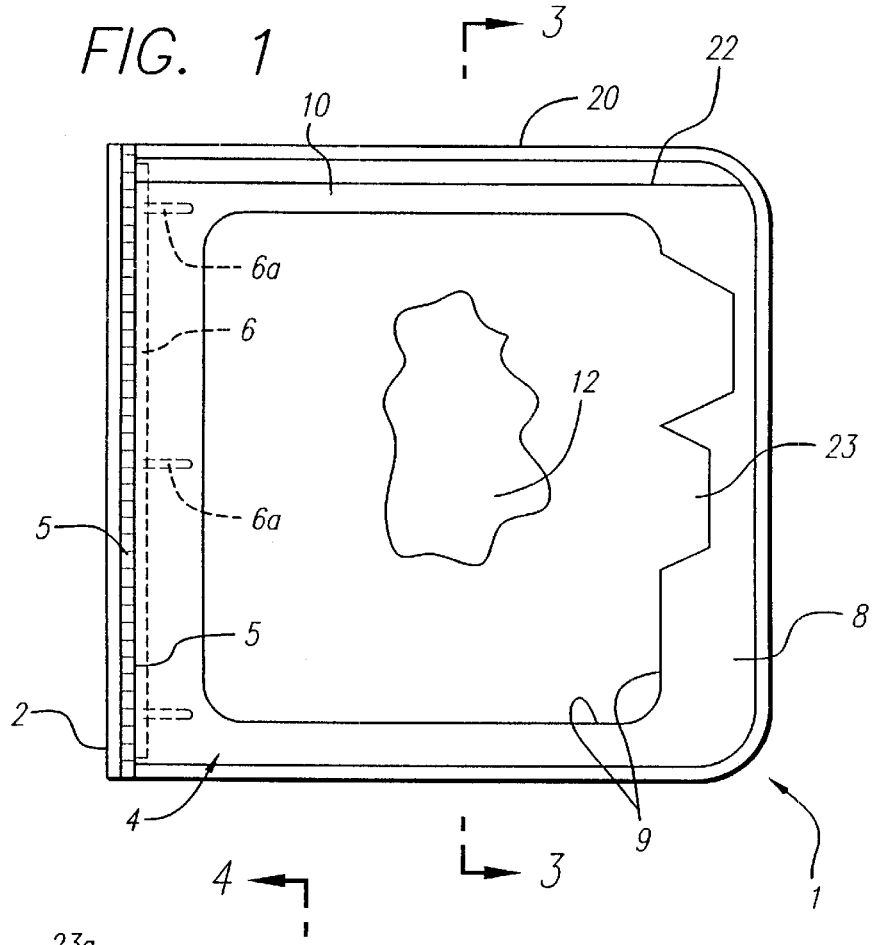
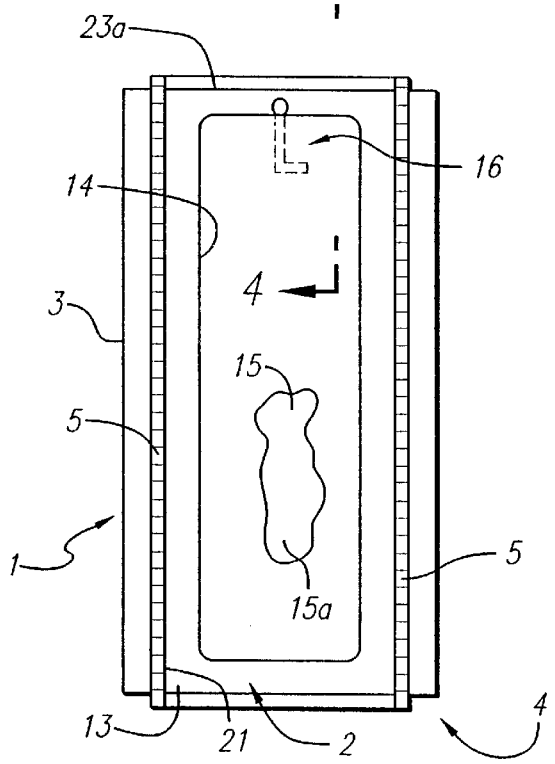
FIG. 2

LOOSE LEAF BINDER INCLUDING AN EXTERIOR PICTURE FRAME

CROSS-REFERENCE TO RELATED APPLICATIONS

This application is a continuation-in-part of U.S. patent application Ser. No. 08/767,940 Filed Dec. 17, 1996. now U.S. Pat. No. 5,857,797.

FIELD OF THE INVENTION

This invention relates to a loose leaf binder for sheets of paper or other material and particularly to a multiple ring binder for the releasable binding of reports, records, and like assemblies of papers, films and the like.

BACKGROUND OF THE INVENTION

Documents and other sheet-like elements are often assembled and bound in a supporting binder. Ring binders are particularly widely used for holding a plurality of interrelated documents and records. The loose leaf documents are readily and conveniently inserted and removed, if necessary, and of course, the binder is readily reused if the content becomes obsolete. In cases of sales presentations as well as various business and other reports, a highly professional presentation of the bound material is desired. The binder as such should present a appearance, as well as a pleasing and interesting presentation of the subject matter. Reports and sales presentations in particular may require assembly of certain documents in a predetermined order to be presented and discussed or reviewed. The well known conventional ring binder often in the form of a three ring binder, may be used. Binders are available with a hard or soft back and front covers interconnected to a connecting base or spine. The spine may be a solid backing member to which the ring assembly is secured. The front and back cover is formed of a relatively flexible material, or of a relatively solid material interconnected to the spine through a suitable flexible connection therebetween.

Binders with special see-through cover structures are available in the prior art. In one binder, a clear plastic outer sheet is attached to the cover and/or spine with an open top edge through which an insert may be inserted. This allows a creative presentation in an initial communication of the material to be presented from within the binder. In another prior art system, a solid cover is formed with an opening with a flexible plastic sheet secured to the back side thereof to form an insert pocket. An informational insert sheet may be inserted with a framed presentation of the insert sheet. The flexible back wall is flexible and may not provide a desired presentation of the inserted display material which is restricted by the size of the window in the prior art as to an 8½×11" sheet as widely used.

However, there is a need for a binder including an external cover presentation which provides a reliable, rugged binder while maintaining highly professional and pleasing exterior presentation of the insert, as well as permitting easy assembly and disassembly of the insert.

BRIEF SUMMARY OF THE INVENTION

The present invention is particularly directed to a loose leaf type binder having a solid front cover and/or a solid spine with the cover interconnected to the spine through a flexible interconnection. Generally, in accordance with a preferred construction of the present invention, the binder spine and cover each include a solid base plate within an outer or exterior surface. A picture frame having a configuration substantially corresponding to that of the base plate at its peripheral edge is secured to the exterior of the base plate of the front cover and/or the spine except along a portion defining an insert opening between the frame and the base plate. The insert opening is of a sufficient dimension to permit insertion of an insert between the base plate and the exterior frame. In a preferred construction, the base plate is encased in an outer shell of relatively thin, but decorative plastic. More particularly in a preferred construction, the binder includes a structure with a solid back spine, a solid front wall or cover, and preferably a solid back wall and cover. An outer plastic frame member defining an enclosed clear window is bonded to the solid cover. An edge portion of the frame abutting the solid cover is open and provides for insertion and removal of an appropriate insert which may include pictures, appropriate information cards, or other desired display material. In a preferred construction, the window frame is secured to the edges of the solid cover along the outer edges except for the top portion of the binder cover, with a clear plastic section secured to the back of frame and extended over the clear window opening. Appropriate construction of the outer surface of the solid cover, as such, and the frame of a generally similar and like surface material, such as like plastics, presents a highly professional presentation with framed wall. In accordance with an aspect in the teaching of the present invention, the cover has sufficient strength and solidity to allow the insert to be inserted smoothly and easily to the very bottom of the window pocket.

In accordance with a further preferred aspect, the back spine of the binder is similar constructed with an inner solid back or spine wall. An outer frame structure consisting of the outer frame and an inner clear covering of the opening again presents a very attractive picture presentation. The upper end is again open for insertion and removal of a attractive, eye catching insert. In practical construction of a typical binder, the back spine may have a dimension on the order of one inch or more with an outer frame secured in place. The upper end of the outer frame and in close abutment to the spine proper. The structure is such that to insert and remove a display sheet can be difficult. Further, the insert is preferably totally hidden within the spine frame. Retrieval is then even more difficult because of the small top-edge opening.

In accordance with another aspect of the present invention, the insert is specially constructed for cooperation with a built-in insert removal device. In a particularly unique and practical construction, the inside has the upper edge thereof folded over and moved essentially completely inwardly behind the outer spine frame. A small hook member is provided with a member extended through a hole in the top of the folded portion and an offset member extended lateral of hole. Pulling the hook member outwardly results in the engagement of the folded portion and a very convenient and ready removal. A simple and effective system is to use a pin hook having an external outer end of the pin provided with a head or other exposed element for ready grasping.

The binder with the picture frame is in a further preferred feature, combined with an appropriate mount mat as a part of the binder. The mount mat can be a suitable advertising document or identification document presented through the picture frame binder as fabricated and sold. The mount mat substantially corresponds to the size of the window pocket. An appropriate display sheet including paper or the like is affixed to the mat. The back side of the mat is provided with insert mounting information including alignment indicia to provide alignment of the display material sheet within the frame opening. For example, the size of the frame opening may be shown in a solid outline. Outwardly thereof an outline corresponding to the conventional 8½×11" letterhead may be provided. Further, with the mat corresponding to the size of the pocket, the display is maintained in the desired registry within the opening.

Thus, the present invention provides a loose leaf binder having a solid spine and cover with a picture frame attached to the solid front cover and/or the solid spine with an edge opening for insertion and removal of the inserted material. The combination of the picture frame presentation and the solid backing for the window portion provides an optimal loose leaf binder of a high strength and customized look which is conveniently adapted to the insertion and removal of the insert within the framed portions.

In accordance with additional features or aspects of the invention, a single type of opaque plastic sheet material less than 20 mils thick may be employed to cover the front cover, the back cover and the spine, and may also be used for the picture frame for the front cover. The plastic sheet material may be of a single color, in the thickness range of between 8 and 20 mils, and is preferably 8 and 15 mils thick. The transparent window may also be formed of thin, flexible, plastic sheet material, less than 20 mils thick, and may be bonded to the inner surface of the frame material, around the window. The window may be formed of this transparent plastic sheet material which is less than 15 mils in the thinkness range of 4 mils to 15 mils, and preferably between 4 and 12 mils thick. Both the opaque plastic sheet material and the transparent window may be formed of polyvinyl chloride material, or any other suitable flexible plastic material, such as polyolefin material. The frame may have a bead immediately adjacent the window to positively delineate and emphasize the edge of the frame. In addition, the window material may be secured to the inner surface of the frame by any appropriate technique, such as by appropriate adhesive, but is preferably bonded by heat and the high frequency bonding.

BRIEF DESCRIPTION OF THE SEVERAL VIEWS OF THE DRAWINGS

The drawings furnished herewith illustrate a preferred construction of the present invention with the above features clearly disclosed, as well as others which will be readily understood from the following description.

In the drawings:

FIG. 1 is a front elevational view of the binder, with a portion broken away and sectioned to show detail of the construction;

FIG. 2 is an elevational view of the spine of the binder in the closed position;

DETAILED DESCRIPTION OF THE PREFERRED EMBODIMENTS

Figure 3:
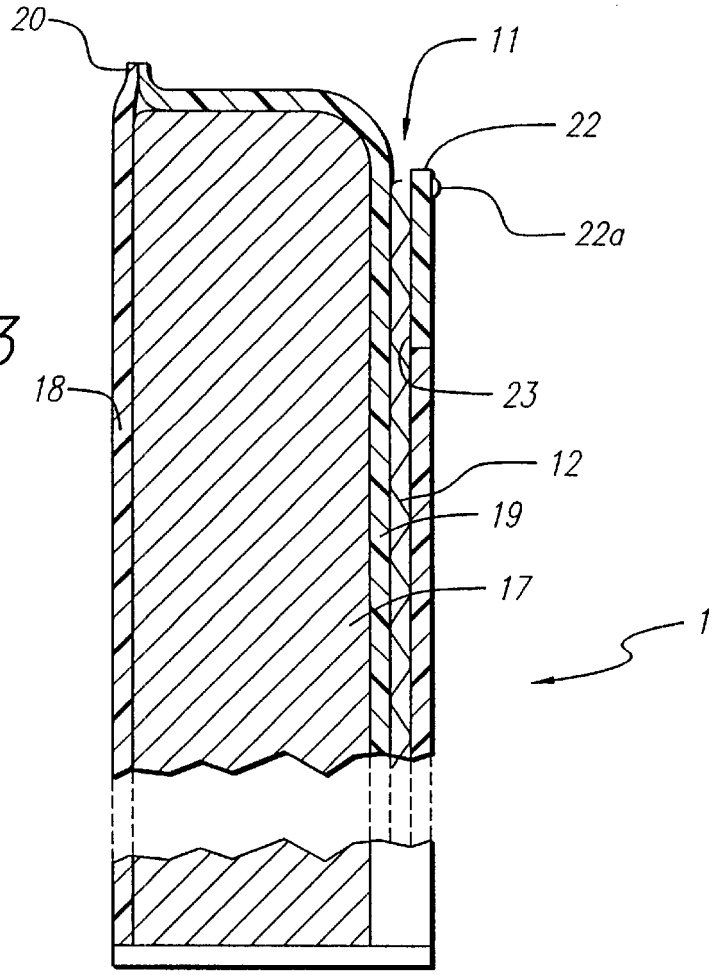
FIG. 3 is a vertical section taken generally on line 3—3 of FIG. 1 and illustrating the front cover construction of the illustrated binder.

Referring to the drawing, and particularly to FIGS. 1–3, a three ring binder 1 is illustrated including a spine 2, with a back cover 3 and a front cover 4 connected to the opposite edges of the spine 2 by hinges 5. A three ring unit 6, shown in FIG. 1, is secured to the back cover 3 or the spine 2. The three ring unit 6 is a conventional construction with the rings 6*a* adapted to be opened for receiving of sheet-like material having spaced apertures along the inner edge for alignment with rings 6*a,* generally in accordance with well known construction.

In accordance with the teaching of the present invention, the illustrated embodiment includes a presentation picture frame 8 secured to the front cover 4. In the illustrated embodiment, the top and bottom portions of the frame have a slightly shorter width than the vertical sides and define a presentation opening 9 within the central portion of the cover 4. The top side and edge portion 10 of frame 8 is not sealed to the cover 4 and provides a top insert opening 11 through which a display sheet or insert 12 may be inserted within the frame 8, as more fully developed hereinafter. The insert 12 may carry any type of information or display material, such as diagrammatically illustrated at 12*a* in FIG. 1.

Referring in particular to FIG. 2, the rectangular spine 2 includes a picture frame 13 defining a central presentation opening 14. The top edge of the frame 13 is spaced slightly below the upper edge of the spine 2, and abuts but is not sealed to the spine proper. Thus, the top edge of the frame 13 provides a corresponding insert opening for insertion, as by sliding, of a suitable insert such as a display strip 15 for presentation of any suitable indicia 15*a*. As more fully developed hereinafter, an insert removal unit 16 is interconnected to the upper end of the spine insert 15 for ready and convenient removal of the spine insert.

In the construction of a preferred embodiment, the spine and front cover, and preferably the back cover, are each formed of a substantially solid and continuous construction, with the separate frames interconnected to and forming a separate overlay on the substantially solid spine 2 and the substantially solid front cover 4.

Referring particularly to FIG. 3, a cross sectional view of an upper portion of front cover 4 is illustrated in a preferred construction of the present invention. The cover 4 includes an inner, substantially solid base plate 17 of suitable paper board or other suitable material. The plate extends substantially throughout the complete depth and width of the front cover 4. A decorative and utilitarian plastic cover enclosure or shell is fabricated enclosing the base plate 17, in accordance with a known construction. The shell includes an inner plastic sheet 18 and an outer plastic sheet 19 extending over the base plate 17. The outer edges of sheets 18 and 19 extend slightly from the plate and are sealed to each other in slightly outwardly projecting and overlapping relation to the outer edge of the base plate, as at 20. The inner side edge of the sheets 18 and 19 merge into and are integrally formed with the adjacent hinged structure 5, as at 21. This fabrication of the three ring binder with the shell enclosed plate-like base plate is a known construction.

In the illustrated embodiment, the frame 8 is similarly formed of a sheet-like plastic, which may be formed of the identical material and color as the shell enclosing the base plate 17 or any desired contrasting color or colors. The opposite side edges of the frame and the bottom edge of the frame project outwardly into merged engagement with the corresponding sealed edges 20 and 21 of the sides and bottom of the exterior shell, and are welded or otherwise bonded thereto. With the frame of a thin plastic material and suitably affixed to the outer surface of the cover and with the cover and frame of the same opaque color, the frame is blended into the cover exterior surface to appear as an extension of the outer surface.

The top side of the frame 8 has its upper edge 22 spaced inwardly from the upper sealed edges 20 of the cover shell to define and locate the insert opening 11. Additionally, the top frame side is fabricated with a slight curvature such that the upper edge 22 is biased into engagement with the cover 4 and forms a substantially invisible top opening. The top edge 22 is shown with a slight enlargement 22*a* to produce a finished edge.

In addition, in a preferred embodiment as illustrated, a clear plastic membrane 23 is suitably secured, for example, as by adhesive bonding, or welding or other securing element, to the interior face of the plastic frame 8 and covering the opening 9 to provide a clear display covered opening 9.

In fabrication of the unit, the picture frame 8 may be assembled with the front and back cover sheets of the shell and simultaneously pivotally welded to attach the frames to the shell as a unit.

Further, in accordance with known construction, the front and back cover sheets 18 and 19 of the shell are correspondingly extended over the spine 2 and the back cover 3 including hinges 5. The spine 2 is spaced from the front and back covers 3 and 4 in assembly. The cover sheets 18 and 19 secured in place including the hinge portions 5 to define the outer shell of the three-ring binder to which the three ring unit 6 is separately secured as by the illustrated rivets.

The back spine frame 13 is similarly interconnected in overlying relation to the back spine 2 and interconnected at the outer edges as a part of the hinge structure 5. The back spine frame 13 also includes a clear plastic window secured to the inner face of the frame 13 and covering the frame opening 14.

The spine frame 13 and the cover frame 8 may be fabricated of a continuous plastic sheet with the clear window plastic secured to the inner faces of the two frames. The dual frame sheet is overlaid with the shell sheets 18 and 19 and simultaneously interconnected to form the finished picture framed binder 1.

Figure 4:
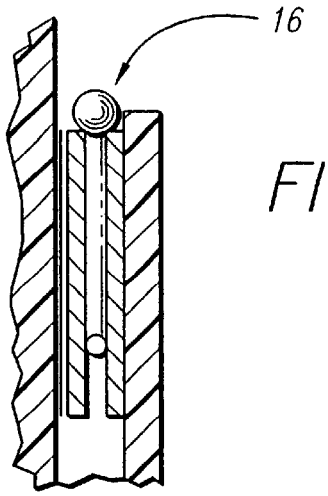
FIG. 4 is a fragmentary section taken generally on line 4—4 of FIG. 2 and illustrating the spine wall and frame interconnection to the front cover.
Figure 6:
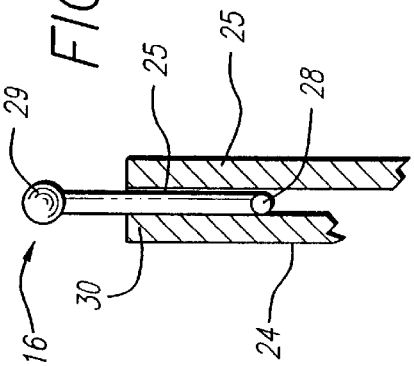
FIG. 6 is a vertical section taken on lines 6—6 of FIG. 5.
Figure 5:
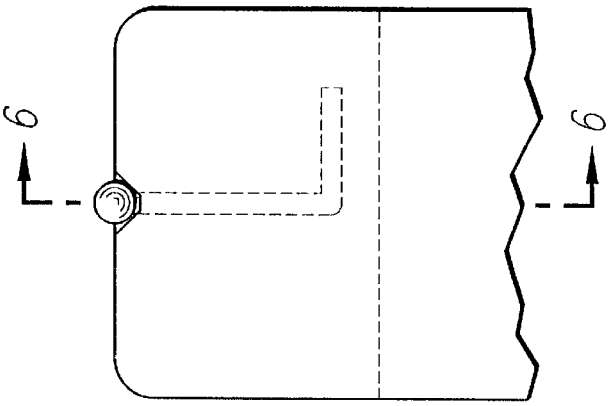
FIG. 5 is a fragmentary illustration of the top end of a spine insert.

The insert opening 23*a* to the spine frame 13 provides for convenience and smooth sliding insertion of an insert 15 when formed of any material having a suitable column strength. To provide for ready removal, the separate removal unit 16 is connected or coupled, to the spine insert 15 and permits sliding withdrawal of the insert from the spine picture frame. In the illustrated embodiment (most clearly shown in FIGS. 4–6), the insert 15 is formed with the upper portion including a folded portion 24 defining a double wall structure which is shown inserted totally within the top side of the spine frame 13. The center of the folded portion 24 has a removal notch and opening 25 in the top edge thereof. The illustrated removal unit 16 includes a rod-like structure having a thin rod 27 extended through the removal opening 25. The inner end of the rod 27 is offset as shown by a lateral extension thereof to form an L-shaped leg 28. The inner leg 28 is aligned with the folded edge of the insert 15. The rod 27 extends outwardly through the opening 25 with a small, decorative pin head 29, shown as a bead, which prevents movement of the pin completely into the folded portion 24. The upper or top edge of the folded portion 24 is illustrated with a small notch 30 within which the pin head 29 rests with the inner leg retained within the frame's folded portion 24. To remove the insert 15, the user merely grasps the head 29 and pulls outwardly; rapidly and smoothly sliding the insert from the picture frame 13. The illustrated removal device is particularly aesthetically effective. Thus, it maintains the picture frame in an appropriate continuous frame presentation while permitting a ready removal of the insert.

The removal device can be any suitable structure which can be inserted into the opening, and may not be provided with the unit. Rather, only necessary information as to how to use the particular system may be set forth.

The user can readily use any simple, relatively thin but sufficiently solid device for insertion into the opening. For example, a simple, conventional paper clip provides an end which can be inserted into the notch or opening, and moved underneath the folded edge for removal of the insert. Even the tip of a pencil or the like can be similarly used as a removal instrument. This avoids the provision of the sharp, pin like element which can, of course, create an injury if not properly handled. If a device is provided, the device preferably does not have a sharp point, and is provided with sufficient warning, so that the device will always be used properly.

Figure 8:
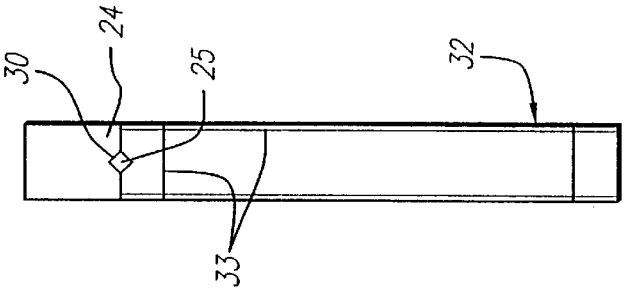
FIG. 8 is a plan view of a mat for the binder spine.
Figure 7:
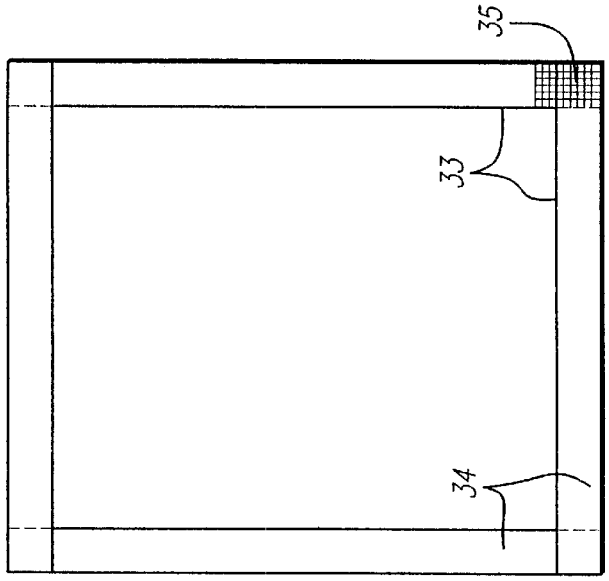
FIG. 7 is a plan view of a mat for the binder front cover.

The binder with the picture frame is, in a further preferred feature, combined with an insert defining an appropriate mount mat as a part of the binder. The mount mat insert, as provided with the binder, can be a suitable advertising document or identification document presented through the picture frame binder as fabricated and sold to the user. The mount mat 32 as shown in FIGS. 7 and 8 substantially corresponds to the size of the window pocket. The back side of the mat 32, as shown in FIG. 7, is provided with insert mounting information. The size of the frame opening is shown, for example, as a solid line 33. Securement of a display sheet of paper or the like within the solid line aligns the display sheet for presentation through frame opening 9 or 14. Outwardly of the frame opening line 33 is a dotted square line 34 corresponding to the conventional 8½ by 11 sheet of letterhead and the like. Placement of the insert letterhead or other 8½ by 11 sheet on the mat 32 within the line aligns the material within the frame 8. The border between the defining lines 33 and/or 34 of the mounting mat 32 and the outer edge thereof may be provided with conventional rectangular coordinate lines 35 on any desired spacing, such as ⅛" spacing for aligning other sized documents for centered positioning within the frame opening 14. In the assembly using the mat, the displayed material may be simply in the form of a paper sheet which is suitably bonded to the mounting base, as by a suitable adhesive, tape or any other means. The mounting mat 32 may be constructed of a semi-solid paper or cardboard having a sufficient column strength for ready insertion and removal of the display sheet. In this regard, the base mat 32 is preferably constructed of a stiff paper, for example an eight pound stock, with the grain of the paper extended in a vertical direction rather than in a horizontal direction. This limits paper curling within the window frame and promotes the easy insertion and removal of the mat and display unit.

The mat is thus slidingly mounted within the pocket for appropriate insertion of the display material as well as the subsequent removal where desired or necessary.

The mat is constructed such that once inserted into the pocket, it provides the desired presentation of the display within the frame opening. Further, another very significant advantage is that with the mat corresponding to the pocket opening, the display material is held in the desired display position. Thus, the mat cannot shift within the pocket and maintains appropriate registry of the displayed material.

A similar mat preferably is provided as a part of the spine frame structure which, in addition, includes the upper or top folded portion with the access opening. In this instance, the mounting base is formed with an appropriate outline of the frame opening within the mounting base proper which is shaped to essentially correspond rather precisely to the spine frame pocket.

In a three ring binder of a standard size for 8½ by 11 sheets, the binder frame defines a pocket having a depth of substantially 11 and ⅜ inches, and a width in excess of 9 inches. The width of the mounting mat corresponds to the width of the window pocket. This provides for convenient presentation of the window opening from the mounting mat as well as a standard correspondence paper of 8½×11 inches. In addition, the edge coordinates provided on the outer edge provide for adjustment for different sizes of display material. Thus, the mounting mat not only constitutes a physical support to improve the easy insertion and removal of the display material, but provides a convenient device for accurately presenting of the material within the frame opening in accordance with any desired orientention, including an acurately centerd orientation.

In one construction of a binder, the spine frame is constructed to receive a 1 inch by 11 inch insert with the mounting mat having a corresponding construction, and preferably the special upper portion for receiving an insert removal device. In one construction of a binder, a spine viewing area of 1 inch by 9 19/32 inches was presented. The front frame opening had a viewing opening of 8 3/16×9 19/32 inches.

Thus, the frame structure permits the user to provide an attractive, highlighted and customized insert sheets, photos and the like, all framed within the outer edge portion of the window pocket, including the cover and/or spine of a binder.

Generally in accordance with the broadest aspect of this invention, the frame of this invention can be used on any binder adapted to be folded or closed with the covers in overlying relationship and moved to an opened position with the covers in a substantially flat relationship to each other and the spine. The picture frame, as shown in the embodiment, has an outer configuration substantially corresponding to the exterior surface of the cover and/or spine to be provided with the insert pocket. The picture frame is formed with an outer configuration substantially corresponding to that of the exterior surface, with the display opening appropriately located within the frame. A clear plastic membrane covering is fixedly secured to the interior surface of the picture frame and the picture frame is then secured to the exterior surface along its outer edge. The securement means can be any known or desired element or method which will firmly attach and secure the outer edge of the frame to the exterior surface substantially throughout the length of the outer edge but including at least one unsecured and opened portion, as shown. The latter defines the opening for insertion and removal of the display material. In a preferred embodiment, the secured outer end edges blend into the flat surface to appear as an extension of it, generally as shown in FIG. 1. With the exterior surface and the frame of a similar opaque color, the framed opening provides a particular attractive presentation.

The present invention, and particularly the illustrated embodiment of the present invention, produces a highly aesthetic presentation of the binder. The binder may, therefore, be used for personal and commercial purposes, including gathering and storing information, as well as presenting loose leaf materials in the course of operating various endeavors and functions.

Various modifications and changes in the illustrated embodiment may be readily made within the teaching of the present invention and the features shown in the illustrated embodiment. Thus, binders may be made with only a framed spine as illustrated, with or without the preferred removal device. Other means coupled to the insert may, of course, be provided. In addition, the insert may be formed with appropriate structure for receiving a separate removal device. For example, even in the illustrated embodiment, the pin unit need not be fixed to the insert directly. Thus, the insert can be formed with the opening or other engageable structure and inserted into the frame. A separate element can then be inserted to engage the structure and reoriented for engagement therewith, such as a folded structure as shown, when it is desired to remove the insert. The insert may also, for example, have an inconspicuous portion exposed for insert removal. The illustrated embodiment, of course, has the very distinct advantage of securing the removal device in place while maintaining the complete aesthetic presentation of the spine picture frame structure.

Further, similar removal devices might be applied for removal of the front cover insert. Generally, it has been found that use of a separate removal device is unnecessary because the extended length of the front cover picture frame permits sufficient separation movement of the top frame portion for ready access to the front cover insert. Other modifications may provide for the insert opening located other than along the preferred top edge. Although preferably formed of integrated structures, including the integrated frame simultaneously coupled to and bonded to the basic covered binder, the present invention may include separate application of an outer frame to any desired binder having the substantially solid base plate structure.

Figure 9:
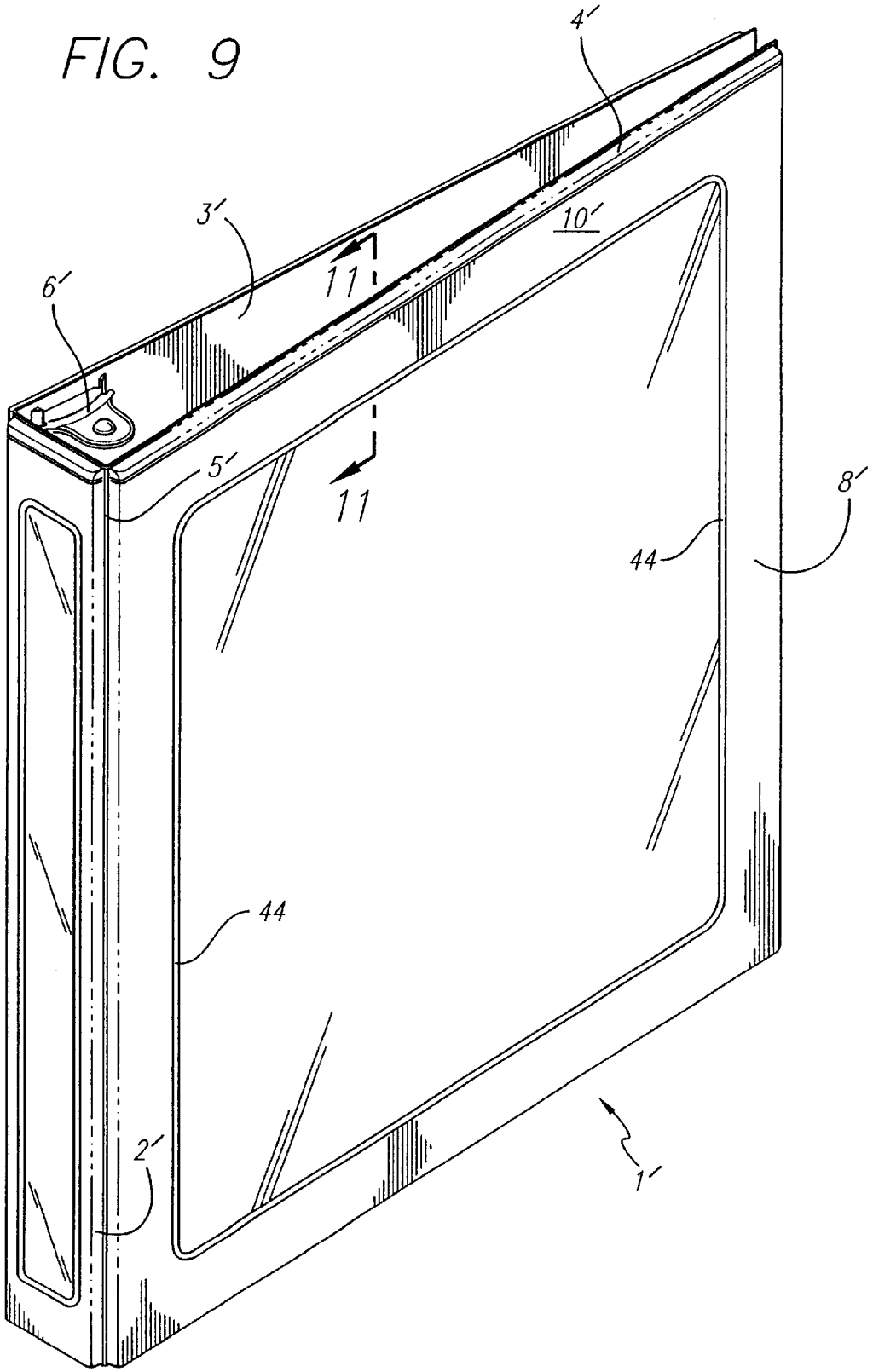
FIG. 9 is a perspective view of a notebook illustrating the principles of the invention.
Figure 10:
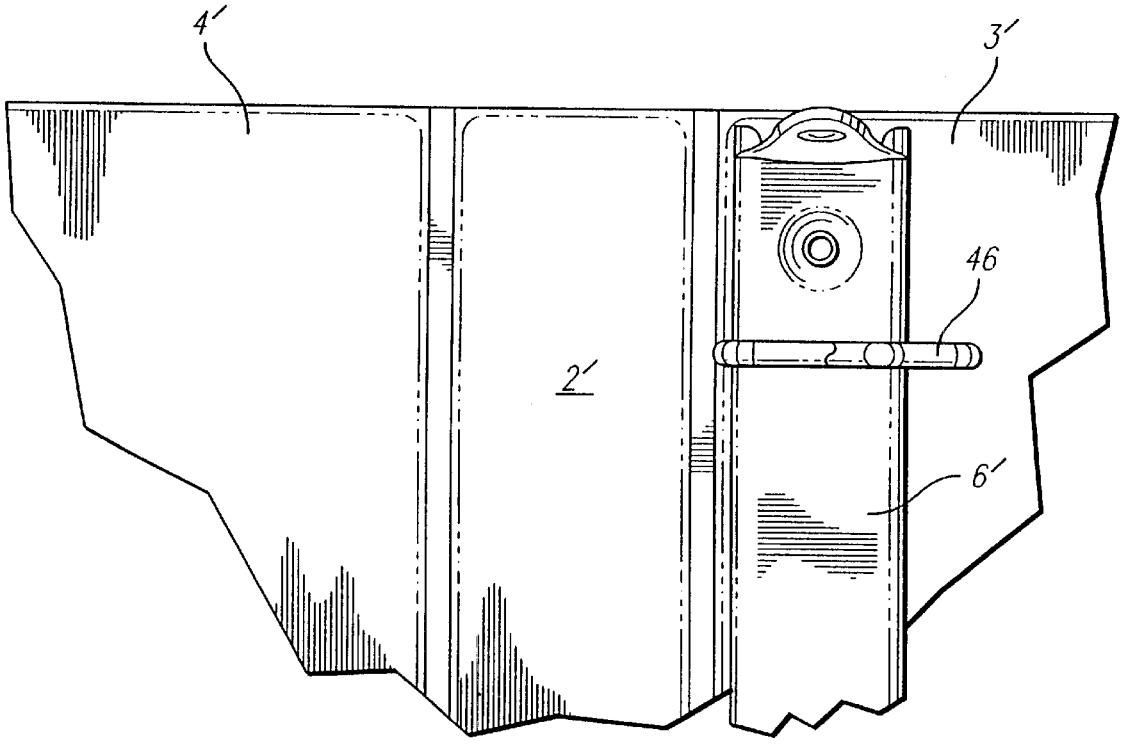
FIG. 10 is a fragmentary view of the inside of the notebook of FIG. 9.
Figure 11:
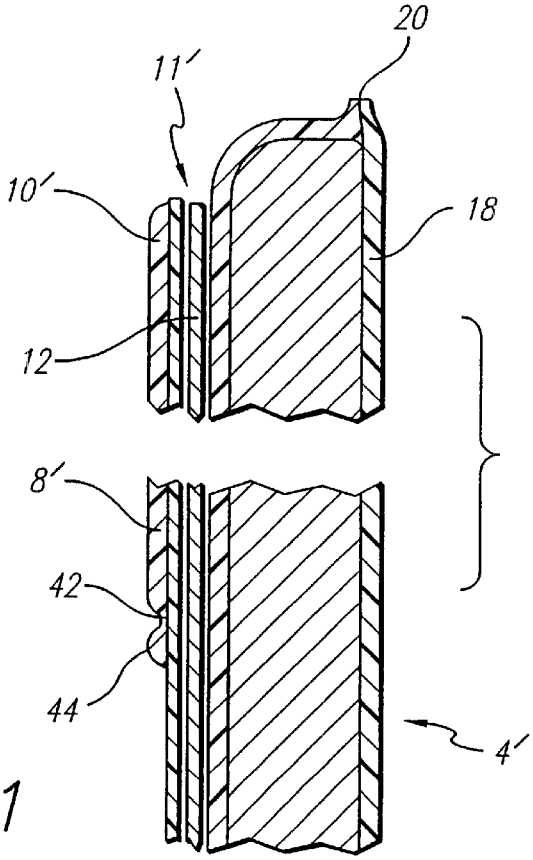
FIG. 11 is a cross-sectional view taken through the front cover of the notebook along line 11'—11' of FIG. 9.

Referring now to FIGS. 9 through 11, a notebook is shown and described in part through the use of reference numerals which correspond generally to those employed in the description of FIGS. 1–8, with the exception that primed reference numerals are employed. Further, the description of FIGS. 1–8 are applicable to FIGS. 9 through 11, using corresponding reference numerals.

In the implementation of the invention, the preferred embodiment, as shown in FIG. 9, has an attractive appearance, with the flexible plastic sheet material covering the front and back covers being the same type of plastic sheet material which forms the frame on the front cover of the notebook. The plastic sheet material may be of a single color and material, thereby enhancing the appearance of the notebook.

In one embodiment of the invention, the opaque plastic sheet material covering the notebook and forming the frame is 12 gauge polyvinyl chloride, 0.012 inch thick. More generally, it is desirable to use plastic material which is at least 0.008 inch but less than 0.020 inch and preferably between 8 mils and 15 mils thick. Concerning the transparent window it may also be formed of polyvinyl chloride, but may also be formed of other transparent plastic material such as polyolefin. The window in one preferred embodiment was formed of 7 gauge plastic sheet material, 0.007 inch thick. More generally it is contemplated that the window may be between about 4 and about 15 thousandths of an inch thick, and preferably between 4 and 12 mils thick.

The sheet material forming the window overlaps the frame and may be heat and pressure bonded to the frame, preferably by high frequency welding. At the time of bonding the frame and window, a groove 42 and a bead 44 may be formed around the window. In the formation of the frame and window assembly, substantially equal size sheets having the dimensions of the exterior of the frame may be bonded together at their edges, and the two layers may be subsequently die cut through the opaque layer only, and the central section of the thicker opaque frame material removed, to leave the sub-assembly with the framed window or windows.

Concerning another matter, with reference to FIG. 10, it may be noted that the ring assembly 6', with one ring 46 (of the three ring binder) visible, is secured to the inner edge of the rear cover 3', to facilitate manufacture of the binder with the inclusion of the picture frame on the spine 2' of the binder.

For completeness it is further noted that the chipboard or paper board base plates for the front and rear covers are preferably about 0.1 or 0.095 inch thick, with somewhat greater or lesser thicknesses being employed, depending on the desired use of the binders. The picture frame feature of the binders could also be used on binders of the type having front and rear covers formed of a single layer of plastic material, with the covers being either flexible or fairly stiff. The frame and window subassembly would then be secured to the front cover of such notebooks.

Various modes of carrying out the invention are contemplated as being within the scope of the following claims particularly pointing out and distinctly claiming the subject matter which is regarded as the invention.

What is claimed is:

1. A loose leaf binder including an exterior picture frame comprising:

a solid front cover;

a solid rear cover;

a solid spine hingedly coupled to said front and rear covers;

a picture frame secured to an exterior surface of said front cover, said frame consisting solely of a peripheral opaque border of flexible plastic sheet material, and a central transparent flexible plastic sheet window, said peripheral border and said transparent window being formed of plastic which is less than 0.020 inch thick;

said frame having outer edges secured to said front cover and including at least one open side unsecured to said front cover for insertion and removal of display material between said cover and said picture frame; and wherein said front cover consists solely of a single base plate covered with opaque flexible plastic and said frame and said window.

2. A loose leaf binder including an exterior picture frame as defined in claim 1 wherein said border of said picture frame has a bead formed along its inner edge immediately adjacent the transparent window.

3. A loose leaf binder including an exterior picture frame as defined in claim 1 wherein said spine is provided with a picture frame of substantially the same configuration as the picture frame as defined above, relative to said front cover.

4. A loose leaf binder including an exterior picture frame as defined in claim 3 wherein said binder is provided with a three ring assembly for holding loose leaf pages mounted on the rear cover of said binder adjacent said spine.

5. A binder including an exterior picture frame comprising:

a solid front cover;

a solid rear cover;

a solid spine hingedly coupled to said front and rear covers;

each of said covers and said spine including a solid base plate covered on both sides with opaque flexible plastic sheet material between about 0.008 and about 0.020 inch thick;

a picture frame secured to an exterior surface of said front cover, said frame consisting solely of a peripheral opaque border of flexible plastic sheet material between about 0.008 and about 0.020 inch thick, and a central transparent flexible plastic sheet window bonded to said border, said transparent window being formed of plastic which is between about 0.004 and about 0.012 inch thick;

said frame having outer edges directly secured to said flexible plastic sheet material of said front cover and including at least one open side unsecured to said front cover for insertion and removal of display material between said cover and said picture frame; and the opaque flexible plastic sheet material forming said border of said frame, and that covering said front and rear covers being of substantially the same color.

6. A loose leaf binder including an exterior picture frame as defined in claim 5 wherein said border of said picture frame has a bead formed along its inner edge immediately adjacent the transparent window.

7. A loose leaf binder including an exterior picture frame as defined in claim 5 wherein said spine is provided with a picture frame of substantially the same configuration as the picture frame as defined above, relative to said front cover.

8. A loose leaf binder including an exterior picture frame as defined in claim 7 wherein said binder is provided with a three ring assembly for holding loose leaf pages mounted on the rear cover of said binder adjacent said spine.

9. A loose leaf binder including an exterior picture frame as defined in claim 5 wherein said open side is at the top of said front cover.

10. A binder for containing loose leaf material comprising:

a spine connected between front and back covers and having a closed position with the covers in overlying relationship and an opened position with said covers lying in a substantially flat relationship to the opposite sides of said spine, at least one of said covers and spine being formed of a substantially solid base plate and including a substantially flat exterior surface and an external picture frame having an outer configuration substantially corresponding to that of said exterior surface and including an inner display opening and an outer securement edge, a clear plastic covering fixedly secured to the inner surface of said picture frame, said picture frame having said outer edge abutting said exterior surface, and a securement means securing said outer edge to said exterior surface about substantially the length of said outer edge and including at least one unsecured opened portion of said free edge from said exterior surface for insertion and removal of display material between said exterior surface and said picture frame; and said opening being covered with a window bonded to said frame, and said frame and said window both consisting solely of flexible plastic sheet material less than 0.020 inch thick, and wherein said front cover consists solely of a single base plate covered with opaque flexible plastic and said frame and said window, with said window being bonded to said frame, and with said frame and window having a thickness of less than 20 mils.

11. A loose leaf binder including an exterior picture frame as defined in claim 10 wherein said spine is provided with a picture frame of substantially the same configuration as the picture frame as defined above, relative to said front cover.

12. A loose leaf binder including an exterior picture frame as defined in claim 10 wherein said front and back covers are covered with the same type of flexible plastic sheet material which forms said frame.

13. A loose leaf binder including an exterior picture frame as defined in claim 10 wherein said border of said picture frame has a bead formed along its inner edge immediately adjacent the transparent window.

14. A loose leaf binder including an exterior picture frame as defined in claim 10 wherein said open side is at the top of said front cover.

15. A loose leaf binder including an exterior picture frame comprising:

a substantially solid front cover;

a rear cover;

a spine hingedly coupled to said front and rear covers;

each of said covers and said spine including a base plate covered on both sides with opaque flexible sheet material;

a picture frame secured to an exterior surface of said front cover, said frame consisting of a peripheral border of opaque flexible sheet material and a transparent flexible plastic sheet window extending across the opening defined by said border;

said frame having outer edges secured to said front cover and including at least one open side unsecured to said front cover for insertion and removal of display material between said cover and said picture frame;

the opaque flexible sheet material forming said border of said frame, and that covering said front and rear covers being of substantially the same color; and wherein said front cover consists solely of a single base plate covered with opaque flexible sheet material and said frame and said window.

16. A loose leaf binder including an exterior picture frame as defined in claim 15 wherein said binder is provided with a three-ring assembly for holding loose leaf pages mounted on the rear cover of said binder adjacent said spine.

17. A loose leaf binder as defined in claim 15 wherein the outer surface of said front and rear covers and said border include the same type and color of flexible sheet material.

18. A loose leaf binder as defined in claim 17 wherein the outer surface of said front and rear covers and said border include a thin continuous flexible layer of plastic.

19. A binder including an exterior picture frame comprising:

a substantially solid front cover;

a rear cover;

a spine hingedly coupled to said front and rear covers;

each of said covers and said spine including a base plate covered on both sides with opaque flexible plastic sheet material between about 0.008 and about 0.020 inch thick, said plastic forming hinges between said spine and said front and rear covers;

a picture frame secured to an exterior surface of said front cover, said frame consisting of a peripheral border of opaque flexible plastic sheet material between about 0.008 and about 0.02 inch thick, and a central transparent flexible plastic sheet window bonded to said border, said transparent window being formed of plastic which is between about 0.004 and about 0.012 inch thick;

said frame having outer edges secured to said front cover and including at least one open side unsecured to said front cover for insertion and removal of display material between said cover and said picture frame;

the opaque flexible plastic sheet material forming said border of said frame, and that covering said front and rear covers being of substantially the same color and thickness;

wherein said front cover consists solely of a single base plate covered with opaque flexible plastic and said frame and said window; and a ring assembly for holding pages within said binder, said ring assembly being secured to one of said spine, said front cover or said rear cover.

20. A loose-leaf binder including an exterior picture frame as defined in claim 19 wherein said border of said picture frame has a bead formed along its inner edge immediately adjacent the transparent window.

21. A loose-leaf binder including an exterior picture frame as defined in claim 19 wherein said spine is provided with a picture frame of substantially the same configuration as the picture frame defined above, relative to said front cover.

22. A loose-leaf binder including an exterior picture frame as defined in claim 19 wherein said binder is provided with a three-ring assembly for holding loose-leaf pages mounted on the rear cover of said binder adjacent said spine.

* * * * *